United States Patent [19]

Brust et al.

[11] 4,282,305

[45] Aug. 4, 1981

[54] RECEIVING ELEMENTS FOR IMAGE TRANSFER FILM UNITS

[75] Inventors: David P. Brust; Lewis R. Hamilton; Glenn R. Wilkes, all of Rochester, N.Y.

[73] Assignee: Eastman Kodak Company, Rochester, N.Y.

[21] Appl. No.: 3,169

[22] Filed: Jan. 15, 1979

[51] Int. Cl.[3] ..... G03C 1/40; G03C 5/54

[52] U.S. Cl. ..... 430/213; 430/237; 430/238; 430/941

[58] Field of Search ..... 96/3, 29, 77, 114, 84 A, 96/119 R; 101/464; 428/500; 430/213, 237, 941, 238

[56] References Cited

U.S. PATENT DOCUMENTS

| | | | |
|---|---|---|---|
| 2,774,668 | 12/1956 | Rogers | 96/77 |
| 3,075,841 | 1/1963 | Lehman et al. | 96/77 |
| 3,081,167 | 3/1963 | Goulston | 96/77 |
| 3,196,014 | 7/1965 | Rogers | 96/77 |
| 3,619,155 | 11/1971 | Young | 96/77 |
| 3,709,693 | 1/1973 | Bloom et al. | 96/77 |
| 4,142,891 | 6/1979 | Baigrie et al. | 96/77 |

FOREIGN PATENT DOCUMENTS

| | | |
|---|---|---|
| 905701 | 9/1962 | United Kingdom . |
| 1121995 | 7/1968 | United Kingdom . |

*Primary Examiner*—Richard L. Schilling
*Attorney, Agent, or Firm*—Arthur H. Rosenstein

[57] ABSTRACT

An image dye receiving element comprises a support having thereon in order:

(1) a layer comprising a source of metal ions and a binder therefor; and (2) a dye image receiving layer comprising a polymer containing heterocyclic tertiary groups.

The receiving element can be used in an image transfer film unit which contains a dye ligand or dye ligand former and the film unit is stable to metal ion wandering and the resulting metallized dye image is stable to fading.

25 Claims, 1 Drawing Figure

RECEIVING ELEMENTS FOR IMAGE TRANSFER FILM UNITS

The present invention relates to useful photographic film units containing at least one silver halide emulsion layer associated with at least one dye ligand or dye ligand former; a polymeric mordant containing heterocyclic tertiary amine groups, and a layer, adjacent to the mordant layer and located on the side of the mordant layer furthest from said dye or dye forming layer, comprising a source of transition metal ions and a binder therefor.

The use of various dyes and dye forming materials in photographic processes and particularly in image transfer processes has been known for quite some time. In many cases, however, dye image stability has been a problem in that the dyes might tend to wander from the image-receiving layer after processing and, additionally, over a period of time the image fades due to light exposure, etc.

The use of metal complexes of some ortho-substituted azo dyes in image transfer processes reduces fade, as these metallized dyes have been found to be extremely light resistant.

Premetallized dyes are described in U.S. Pat. Nos. 3,482,972, 3,453,107, 3,563,739, 3,597,200 and 3,705,184 wherein premetallized dye developers are coated in the image-forming element of an image transfer film unit and release metallized dyes as a function of exposure. On development, these premetallized dyes then diffuse to an image receiving layer. In some instances, a metallic salt can be in a receiving layer and the dye or dye forming material can be metallizable rather than premetallized. That is, the dye or dye forming material contains groups which will chelate with the metal ions to form the metallized dyes in the receiver, such as described in U.S. Pat. Nos. 3,081,167, 3,196,014 and British Patents 905,701 and 1,121,995.

U.S. Pat. No. 3,619,155 describes an image transfer film unit wherein a polymeric layer containing metal ions is located between the receiving layer and the imaging layer to metallize dye developers prior to the dye developer's reaching the receiving layer to provide a barrier to further transfer of dye developer after the pH level is sufficiently lowered.

It has been found, in some cases, that the metallizable dye approach has the advantages of faster diffusion and the ability to use the metallization as a dye hue shifting mechanism. The use of the metallizable dye or dye former, however, requires the use of a metallizing image receiving layer. In many instances, the presence of the metal ions in the receiving layer results in deleterious sensitometric effects in the light-sensitive emulsion layer and an increase in access time in image transfer processes due to premature metallization. Further, since the metal ion source would be located in the image receiving layer, unwanted color and stain under basic or acidic conditions may occur.

It has been found that a photographic film unit having improved properties and comprising a hydrophilic layer containing metal ions and a layer containing a dye ligand (metallizable dye) or dye ligand former can be separated by a mordant layer comprising a polymer containing heterocyclic tertiary amine groups. The release of the metallizable dye or dye former and subsequent transfer to the image-receiving layer results in metallized dye images collected in the mordant layer which are stable. Further, the metal ions do not diffuse out of the receiving element during coating or processing. In addition, the hue of the resulting dye is improved as its absorption spectrum is narrowed.

BRIEF DESCRIPTION OF THE DRAWING

The FIGURE in the drawing shows a composite of a photographic film unit of this invention. In the drawing, the film unit 1 comprises a film support 2 containing a layer thereon 3 which comprises a hydrophilic binder containing a metal salt. Layer 4 is the image-receiving layer containing the mordant, and layer 5 represents an optional reflecting layer. Layer 6 represents an optional opaque layer and layer 7 designates the image-forming layers containing silver halide emulsion and the dye ligands or dye ligand formers. The pod 8 represents the container for the processing solution (8), layer 9 is a timing layer, layer 10 is an acid neutralizing layer and layer 11 is a film support.

A photographic film unit in accordance with our invention comprises:

Figure 1:
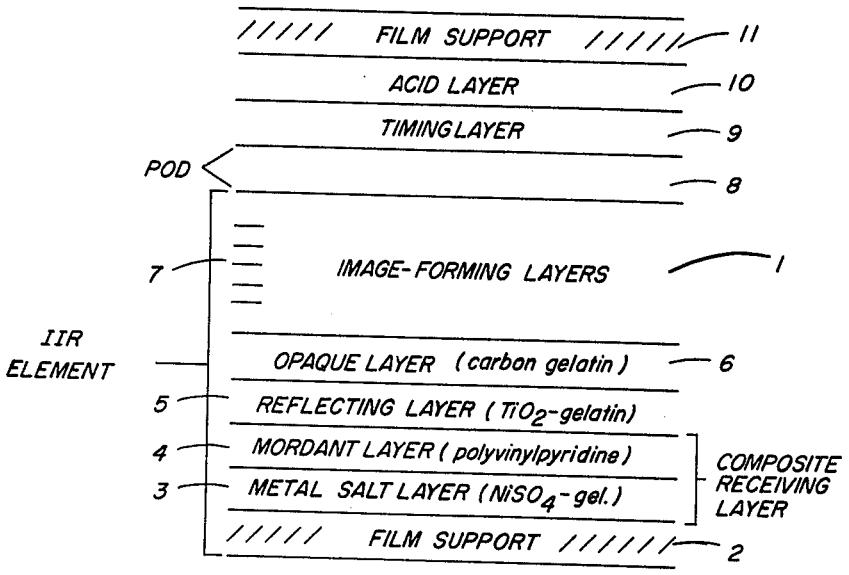

(1) a support having thereon at least one layer containing a photosensitive silver halide emulsion having associated therewith a dye ligand or dye ligand former;

(2) a dye image-receiving layer;

(3) a layer comprising a source of transition metal ions and optionally a binder therefor, said layer being located on the side of the dye image-receiving layer furthest from the next adjacent photosensitive silver halide emulsion; and (4) an alkaline processing composition and means for discharging same within said film unit in contact with said photosensitive silver halide emulsion;

said film unit containing a silver halide developing agent and wherein the dye image-receiving layer comprises a polymer containing heterocyclic tertiary amine groups.

The support for the photographic element can be any support material typically useful for photographic elements such as those described on page 5 of the November, 1976 edition of *Research Disclosure,* the disclosure of which is hereby incorporated by reference.

Associated with the silver halide emulsion is an acid dye ligand or an acid dye ligand forming material. The chelatable acid dye or dye forming material is one which contains chelating groups (any group which will donate a pair of electrons to a metal ion), a salt thereof or a hydrolyzable dye precursor thereof such as an alkali metal salt or a quaternary ammonium salt of a chelating group or a hydrolyzable acyl group. Examples of these chelating groups include hydroxy, amino, carboxy, sulfonamido, sulfamoyl, a hydrolyzable ester having the formula —OCOR′, OCOOR′, —O-$CON(R)^1)_2$ or —COOR′, wherein R′ is an alkyl group having 1 to about 4 carbon atoms, such as methyl, ethyl, isopropyl, butyl and the like, or an aryl group having 6 to about 8 carbon atoms such as phenyl, etc.

Generally, any acid dye or dye forming material containing the above chelating groups will be useful herein as the metallizable dye or dye forming material. Examples of such dyes are those dye developers described in U.S. Pat. Nos. 3,081,167 and 3,196,014 and British Pat. Nos. 905,701 and 1,121,995. Examples of azo dyes useful herein are given on subsequent columns.

Useful dye forming materials include redox dye releasers containing dye moieties containing the chelating groups. These dye forming materials are disclosed in copending U.S. Pat. No. 4,142,891, issued Mar. 6, 1979 by B. D. Baigrie et al. The nondiffusible compounds having a releasable azo dye moiety generally can have the formula:

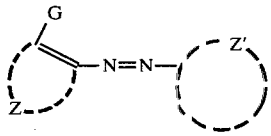

wherein:

Z represents the atoms necessary to complete an aromatic carbocyclic or heterocyclic nucleus having at least one ring of 5 to 7 atoms, such as phenyl, pyridyl, naphthyl, pyrazolyl, indolyl, etc;

Z' is an aromatic carbocyclic or heterocyclic nucleus having at least one ring having 5 to 7 atoms (e.g., the same nuclei as described above for Z), the Z' having in a position adjacent to the point of attachment to the azo linkage either:

(a) a nitrogen atom in the ring of the nucleus which acts as a chelating site, or (b) a carbon atom in the ring of the nucleus having attached thereto a nitrogen atom, either directly or indirectly such as in a sulfamoyl group, which acts as a chelating site;

G is a metal chelating group (any group which will donate a pair of electrons to a metal ion) or a salt thereof (e.g., an alkali metal salt, a quaternary ammonium salt, etc) or a hydrolyzable precursor thereof (e.g., a hydrolyzable acyl or ester group), e.g., hydroxy; amino; carboxy; sulfonamido; sulfamoyl; a hydrolyzable ester group having the formula —OCOR$^1$, —OCOOR$^1$, —OCON(R)$^1$)$_2$ or —COOR$^1$, wherein R$^1$ is an alkyl group having 1 to about 4 carbon atoms, such as methyl, ethyl, isopropyl, butyl and the like, or an aryl group having 6 to about 8 carbon atoms, such as phenyl, etc; or a group which together with

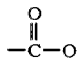

is a ballasted carrier moiety (as defined below) which is attached to the Z-nucleus through the oxygen of the

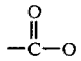

group; the compound containing a ballasted carrier moiety capable of releasing the diffusible azo dye, under alkaline conditions, such as, for example, as a function (either direct or inverse) of development of the silver halide emulsion layer.

In the above formula, G can be either a monovalent group or a nitrogen atom as part of a heterocyclic ring fused to Z. In this later instance, the Z and G atoms can form a nucleus which is the same as the Z' nucleus.

There is great latitude in selecting a carrier moiety which is attached to the azo dye-releasing compounds described above. Depending upon the nature of the ballasted carrier selected, various groups may be needed to attach or link the carrier moiety to the azo dye. Such linking groups are considered to be a part of the CAR moiety in the definition below. It should also be noted that when the dye moiety is released from the compound, cleavage may take place in such a position that part or all of a linking group if one is present, and even part of ballasted moiety may be transferred to the image-receiving layer along with the dye moiety. In any event, the azo dye nucleus as shown above can be thought of as the "minimum" which is transferred.

CAR moieties useful according to the invention are described in U.S. Pat. Nos. 3,227,550; 3,628,952; 3,227,552; and 3,844,785 (dye released by chromogenic coupling); U.S. Pat. Nos. 3,443,939 and 3,443,940 (dye released by intramolecular ring closure); U.S. Pat. Nos. 3,698,897 and 3,725,062 (dye released from hydroquinone derivatives); U.S. Pat. No. 3,728,113 (dye released from a hydroquinonylmethyl quaternary salt); U.S. Pat. Nos. 3,719,489 and 3,443,941 (silver ion induced dye release); and U.S. Pat. Nos. 3,245,789 and 3,980,497; Canadian Pat. No. 602,607; British Pat. No. 1,464,104; *Research Disclosure* 14447, April 1976; and U.S. Pat. No. 4,139,379, issued Feb. 13, 1979, of Chasman et al (dye released by miscellaneous mechanisms).

In a further preferred embodiment, the ballasted carrier moiety or CAR may be represented by the following formula:

(Ballast-Carrier-Link)

wherein:

(a) Ballast is an organic ballasting radical of such molecular size and configuration as to render the compound nondiffusible in a photographic element during development in an alkaline processing composition;

(b) Carrier is an oxidizable acyclic, carbocyclic or heterocyclic moiety (see "The Theory of the Photographic Process," by C. E. K. Mees and T. H. James, Third Edition, 1966, pages 282 to 283), e.g., moieties containing atoms according to the following configuration:

(a)—(—C=C)$_b$— wherein:

b is a positive integer of 1 to 2; and a represents the radicals OH, SH, NH—, or hydrolyzable precursors thereof; and (c) Link represents a group which upon oxidation of said Carrier moiety is capable of being hydrolytically cleaved to release the diffusible azo dye. For example, Link may be the following groups:

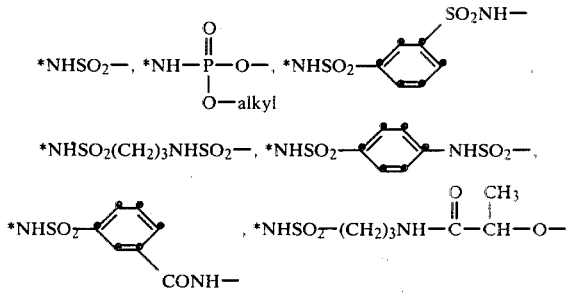

wherein * represents the position of attachment to Carrier.

The Ballast group in the above formula is not critical as long as it confers nondiffusibility to the compound. Typical Ballast groups include long-chain alkyl radicals linked directly or indirectly to the compound as well as aromatic radicals of the benzene and naphthalene series indirectly attached or fused directly to the carbocyclic or heterocyclic nucleus, etc. Using Ballast groups generally have at least 8 carbon atoms such as substituted or unsubstituted alkyl groups of 8 to 22 carbon atoms, a carbamoyl radical having 8 to 30 carbon atoms such as $—CONH(CH_2)_4—O—C_6H_3(C_5H_{11})_2$, $—CON(C_{12}H_{25})_2$, etc, a keto radical having 8 to 30 crbon atoms such as $—CO—C_{17}H_{35}$, $—CO—C_6H_4(t—C_{12}H_{25})$, etc.

For specific examples of Ballast-Carriers-Link moieties useful as the CAR moiety according to this invention, reference is made to the November 1976 edition of *Research Disclosure,* pages 68 through 74, and the April 1977 edition of *Research Disclosure,* pages 32 through 39, the disclosures of which are hereby incorporated by reference.

In a highly preferred embodiment of the invention, the ballasted carrier moiety or CAR in the above formulas is a group having the formula:

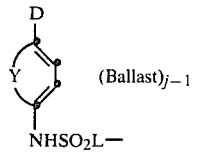

wherein:

(a) Ballast is an organic ballastering radical of such molecular size and configuration (e.g., simple organic groups or polymeric groups) as to render the compound nondiffusible in a photographic element during development in an alkaline processing composition;

(b) D is $OR^2$ or $NHR^3$ wherein $R^2$ is hydrogen or a hydrolyzable moiety and $R^3$ is hydrogen or a substituted or unsubstituted alkyl group of 1 to 22 carbon atoms such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, dodecyl, benzyl, phenethyl, etc. (when $R^3$ is an alkyl group of greater than 8 carbon atoms, it can serve as a partial or sole Ballast);

(c) Y represents the atoms necessary to complete a benzene nucleus, a naphthalene nucleus, or a 5- to 7-membered heterocyclic ring such as pyrazolone, pyrimidine, etc;

(d) j is a positive integer of 1 to 2 and is 2 when D is $OR^2$ or when $R^3$ is hydrogen or an alkyl group of less than 8 carbon atoms; and (e) L is a linking group which is $[X—(NR^4—J)_q]_m—$ or $X—J—NR^4—$ wherein:

(i) X represents a bivalent linking group of the formula $—R^5—L'_n—R^5_p—$ where each $R^5$ can be the same or different and each represents an alkylene radical having 1 to about 8 carbon atoms, such as methylene, hexylene and the like; a phenylene radical; or a substituted phenylene radical having 6 to about 9 carbon atoms, such as methoxy phenylene;

(ii) L' represents a bivalent radical selected from oxy, carbonyl, carboxamido, carbamoyl, sulfonamido, ureylene, sulfamoyl, sulfinyl or sulfonyl;

(iii) n is an integer of 0 or 1;

(iv) p is 1 when n equals 1 and p is 1 or 0 when n equals 0, provided that when p is 1 the carbon content of the sum of both $R^5$ radicals does not exceed 14 carbon atoms;

(v) $R^4$ represents a hydrogen atom, or an alkyl radical having 1 to about 6 carbon atoms;

(vi) J represents a bivalent radical selected from sulfonyl or carbonyl;

(vii) q represents an integer of 0 or 1; and (viii) m represents an integer of 0, 1 or 2.

Especially good results are obtained in the above formula when D is OH, j is 2, Y is a naphthalene nucleus, and G is OH.

Examples of the CAR moiety in this highly preferred embodiment are disclosed in U.S. Pat. No. 4,076,529, issued Feb. 28, 1978 of Fleckenstein et al; U.S. Pat. No. 3,928,312; French Pat. No. 2,284,140; and German Pat. Nos. 2,406,664; 2,613,005; and 2,505,248, the disclosures of which are hereby incorporated by reference, and include the following:

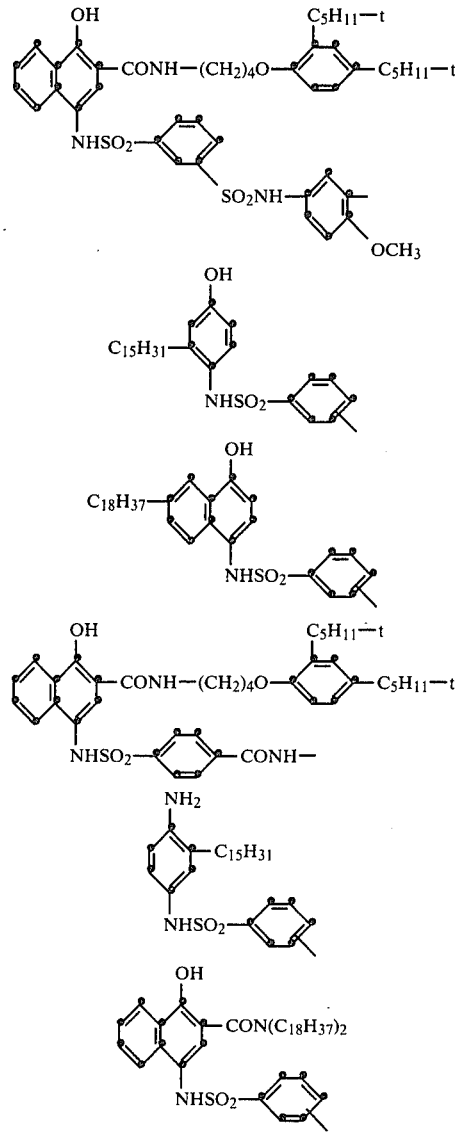

In another highly preferred embodiment, the ballasted carrier moiety or CAR in the above formulas is such that the diffusible azo dye is released as an inverse function of development of the silver halide emulsion layer under alkaline conditions. This is ordinarily referred to as positive-working dye-release chemistry. In one of these embodiments, the ballasted carrier moiety or CAR in the above formulas may be a group having the formula:

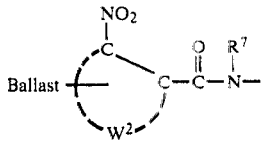

(I)

wherein:

Ballast is an organic ballasting radical of such molecular size and configuration as to render the compound nondiffusible in a photographic element during development in an alkaline processing composition;

$W^2$ represents at least the atoms necessary to complete a benzene nucleus (including various substituents thereon); and $R^7$ is an alkyl (including substituted alkyl) radical having 1 to about 7 carbon atoms.

Examples of the CAR moiiety in this formula I include the following:

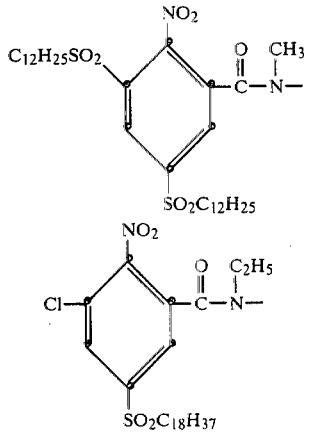

In a second embodiment of positive-working dye-release chemistry as referred to above, the ballasted carrier moiety or CAR in the above formulas may be a group having the formula:

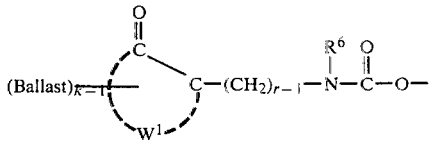

(II)

wherein:

Ballast is an organic ballasting radical of such molecular size and configuration as to render the compound nondiffusible in a photographic element during development in an alkaline processing composition, $W^1$ represents at least the atoms necessary to complete a quinone nucleus (including various substituents thereon);

r is a positive integer of 1 or 2;

$R^6$ is an alkyl (including substituted alkyl) radical having 1 to about 40 carbon atoms or an aryl (including substituted aryl) radical having 6 to about 40 carbon atoms; and k is a positive integer of 1 to 2 and is 2 when $R^6$ is a radical of less than 8 carbon atoms.

Examples of the CAR moiety in this formula II include the following:

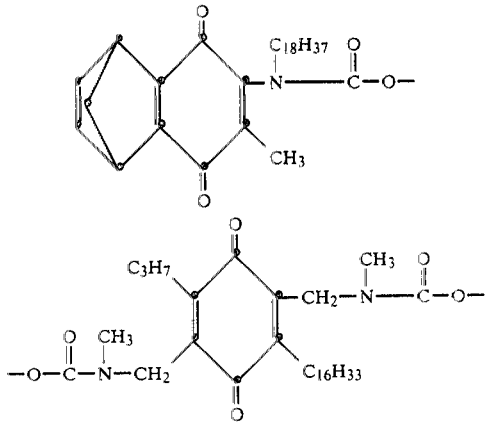

In using the compounds in formulas I and II above, they are employed in a photographic element similar to the other nondiffusible dye-releasers described previously. Upon reduction of the compound as a function of silver halide development under alkaline conditions, the metallizable azo dye is released. In this embodiment, conventional negative-working silver halide emulsions, as well as direct-positive emulsions, can be employed. For further details concerning these particular CAR moieties, including synthesis details, reference is made to U.S. Pat. No. 4,139,379, issued Feb. 13, 1979 of Chasman et al, the disclosure of which is hereby incorporated by reference.

In a third embodiment of positive-working dye-release chemistry as referred to above, the ballasted carrier moiety or CAR in the above formulas may be a group having the formula:

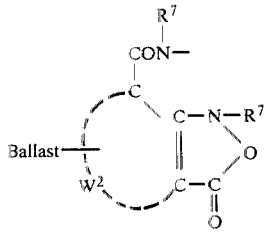

(III)

wherein:

Ballast, $W^2$ and $R^7$ are as defined for formula I above.

Examples of the CAR moiety in this formula III include the following:

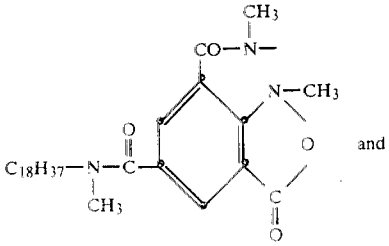

and

-continued

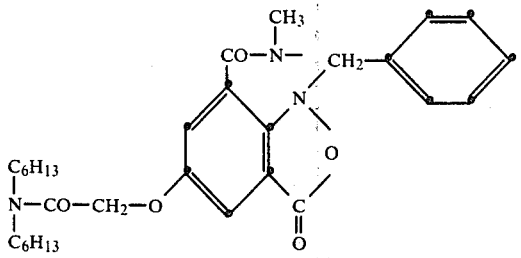

For further details concerning this particular CAR moiety, including synthesis details, reference is made to U.S. Application Ser. No. 534,966 of Hinshaw et al, filed Dec. 20, 1974, the disclosure of which is hereby incorporated by reference.

In a fourth embodiment of positive-working dyerelease chemistry as referred to above, the ballasted carrier moiety or CAR in the above formulas may be a group having the formula:

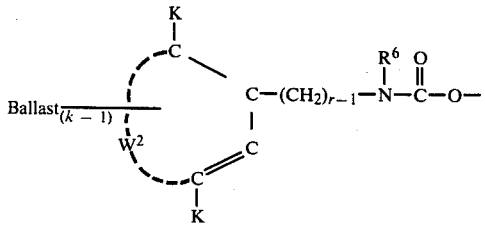

(IV)

wherein:

Ballast, r, $R^6$ and k are as defined for formula II above;

$W^2$ is as defined for formula I above; and

K is OH or a hydrolyzable precursor thereof.

Examples of the CAR moiety in this formula IV include the following:

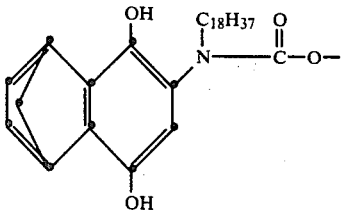

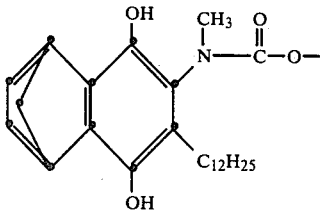

For further details concerning this particular CAR moiety, including synthesis details, reference is made to U.S. Pat. No. 3,980,479 of Fields et al, issued Sept. 14, 1976, the disclosure of which is hereby incorporated by reference.

Representative compounds included within the scope of the invention include the following:

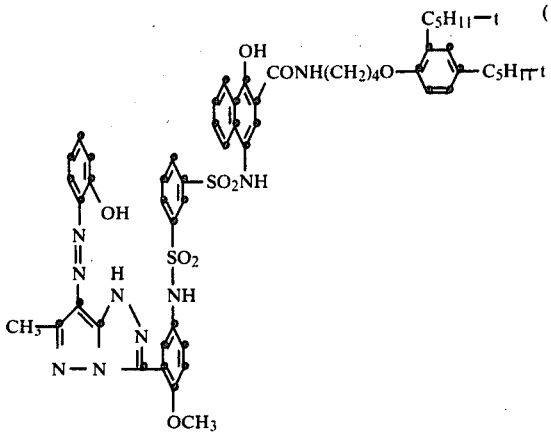

(1)

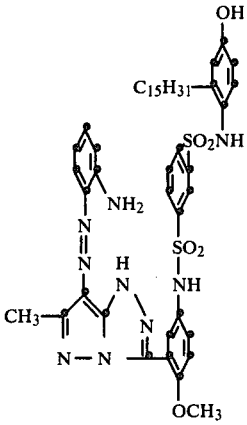

(2)

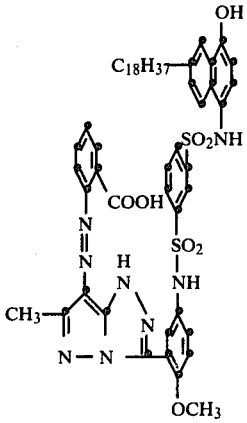

(3)

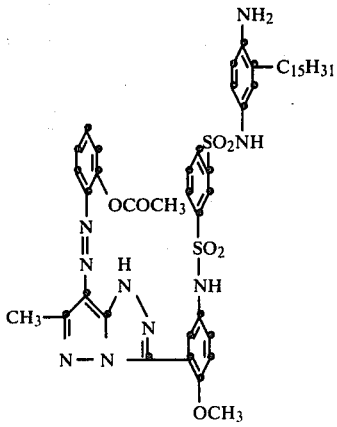

(4)

-continued
(5)
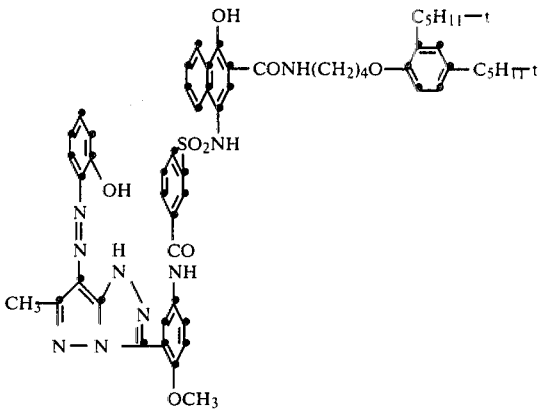
(6)
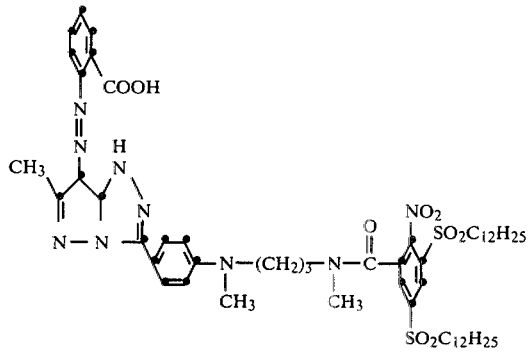
(7)
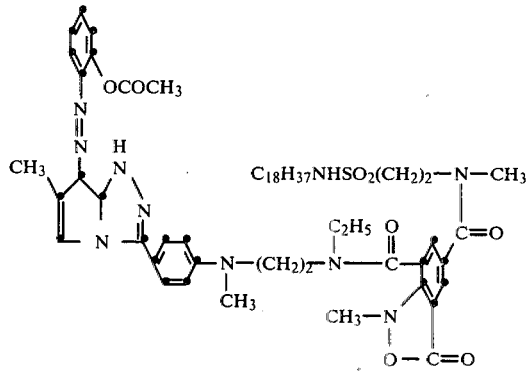
(8)
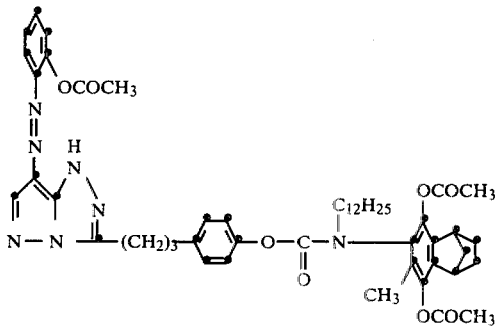
(9)
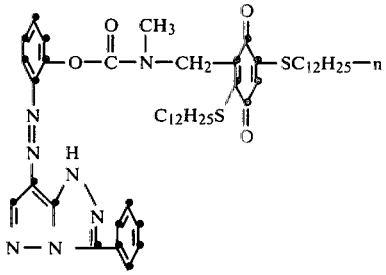
-continued
(10)
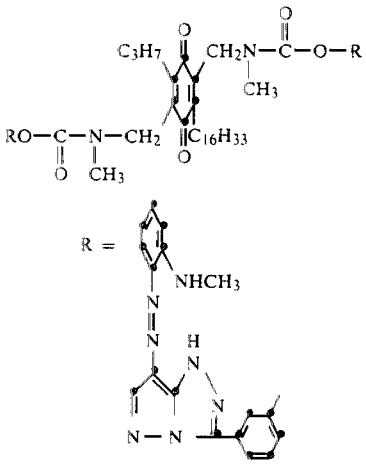
(11)
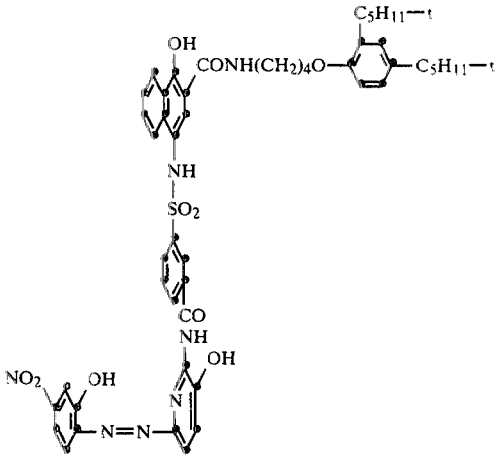
(12)
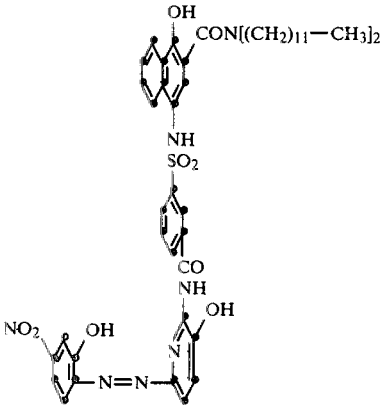
(13)
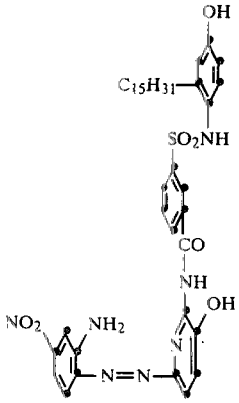

-continued
(14)
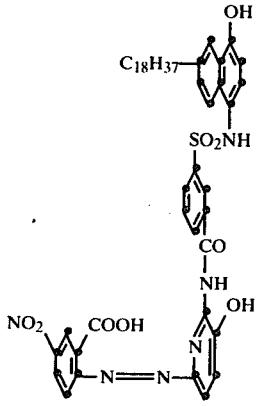
(15)
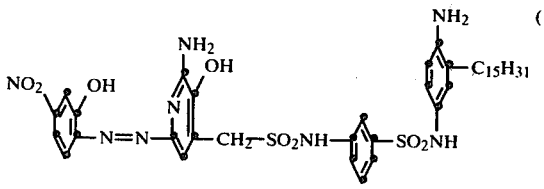
(16)
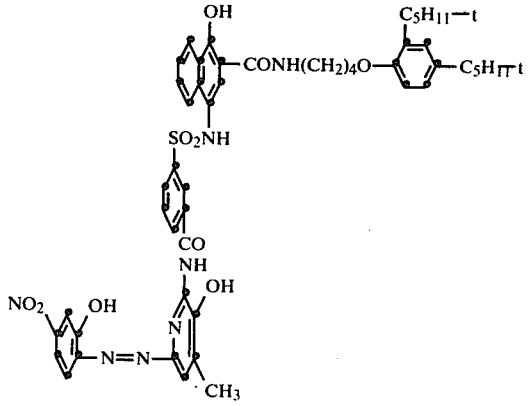
(17)
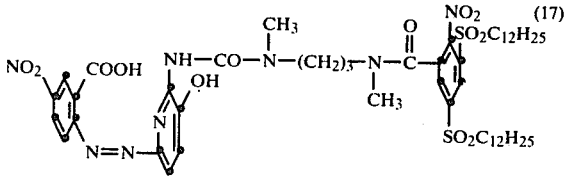
(18)
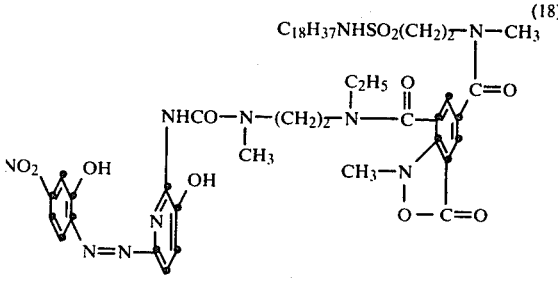
(19)
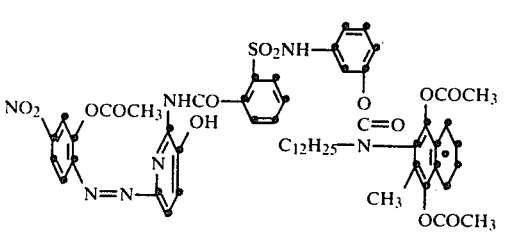
-continued
(20)
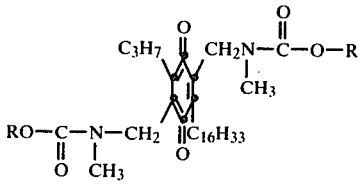
R =
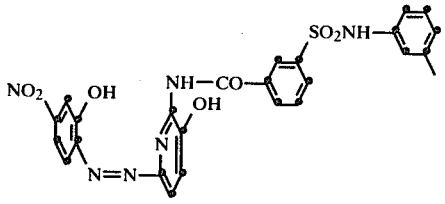
(21)
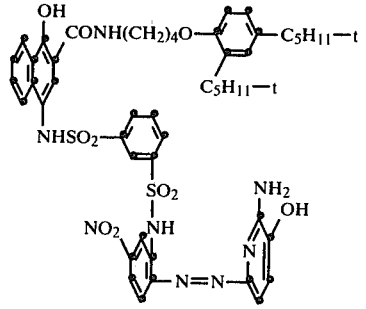
(22)
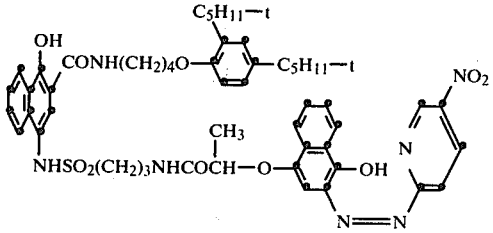
(23)
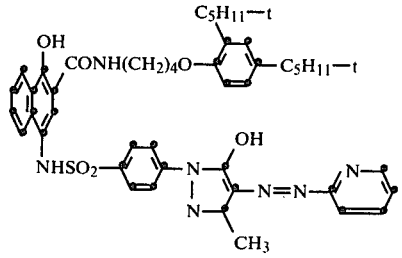
(24)
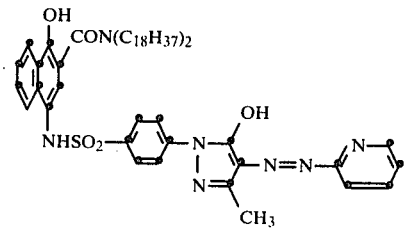

-continued (25)

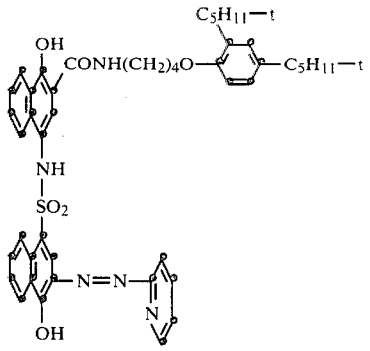

(26)

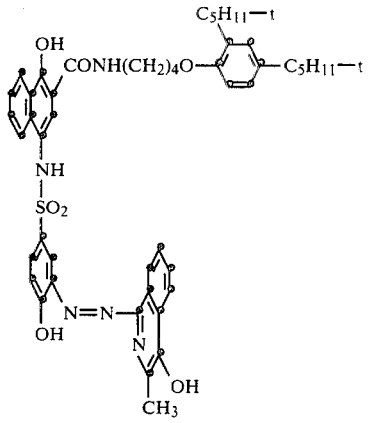

(27)

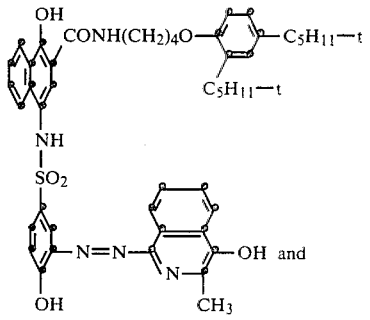

(28)

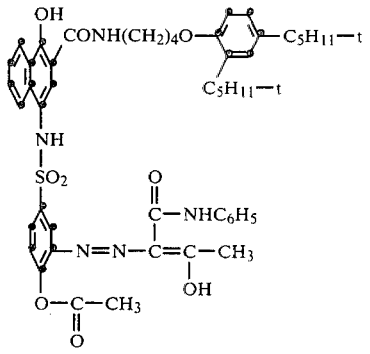

The dye image-receiving layer comprises a polymeric mordant for receiving the dye ligand or dye ligand former. The polymeric mordant must contain heterocyclic tertiary amine groups, such as pyridine, triazole, tetrazole, pyrazole, imidazole, quinoline, pyrimidine, pyrrole, pyridazine, pyrazine, thiazoles, isothiazoles, thiazines, and the like. The preferred polymers are poly(vinylpyridine) and substituted or unsubstituted poly(vinylimidazole). The polymer is generally coated in the layer with a hydrophilic binder, such as gelatin, poly(vinylalcohol), poly(acrylamide), poly(vinylpyrrollidone), hydroxyethyl cellulose and the like. The polymer is preferably in a coverage of 50 to about 400 mg/ft$^2$ (0.093 m$^2$), and the dye-receiving layer must be of a thickness which prevents diffusion of metal ions through the layer before and during processing. Preferably, the thickness of the dye-receiving layer is from about 1 to about 8.4$\mu$.

The layer containing the source of transition metal ions must be located on the side of the dye image-receiving layer furthest from the next adjacent silver halide emulsion layer and dye ligand or dye ligand former-containing layer. This assures the prevention of the untimely diffusion of the metal ions into the imaging layers and allows the mordant layer to be coated thereon without precipitation of the polymer.

Metal ions useful in this invention are those which are essentially colorless when incorporated into the image receiving element, react speedily with the released dye or dye forming material to form a complex of the desired hue and form a dye complex which is stable to heat, light and chemical reagents. In general, good results are obtained with polyvalent metal ions such as copper(II), zinc(II), nickel(II), platinum(II), palladium(II) and cobalt(II) ions. Most preferred are the transition metal ions and especially preferred are nickel(II) and copper(II).

The metal ion source can be any solution of a salt of a metal ion in water. Water-soluble salts useful herein include nickel salts, such as nickel sulfate, nickel nitrate, nickel acetate, nickel chloride, and the like; copper salts, such as copper nitrate, copper sulfate, copper chloride, copper acetate, and the like.

A binder for the metal salt can be used. The binder for the metal salt can be any hydrophilic binder, such as gelatin, poly(acrylamide), poly(vinyl alcohol), poly(vinyl pyrrolidone), hydroxyethyl cellulose, and the like. The metal salt, generally in a coverage of from about $10^{-5}$ to about $10^{-3}$ moles/ft$^2$, binder and water can be mixed with a suitable surfactant, such as Surfactant 10G (p-isononylphenoxypolyglycidol) and coated as a layer using any convenient method of coating, such as brush coating, roll coating and the like. Although the thickness of the layer is not critical, the layer is generally from about 0.4$\mu$ to about 1.6$\mu$.

The photographic element in the above-described process can be treated with an alkaline processing composition to effect or initiate development in any manner. A preferred method for applying processing composition is by use of a rupturable container or pod which contains the composition. In general, the processing composition employed in this invention contains the developing agent for development, although the composition could also just be an alkaline solution where the developer is incorporated in the photographic element, image-receiving element or process sheet, in which case the alkaline solution serves to activate the incorporated developer.

A photographic film unit which can be processed in accordance with this invention is adapted to be processed by passing the unit between a pair of juxtaposed pressure-applying members, such as would be found in a camera designed for in-camera processing, and comprises:

(1) a photographic element as described above;
(2) a dye image-receiving layer; and
(3) means for discharging an alkaline processing composition within the film unit, such as a rupturable container which is adapted to be positioned during processing of the film unit so that a compressive force applied to the container by the pressure-applying members will effect a discharge of the container's contents within the film unit;

the film unit containing a silver halide developing agent.

It will be appreciated that, after processing the photographic element described above, there remains in it after transfer has taken place an imagewise distribution of chelatable dye in addition to developed silver. A color image comprising residual nondiffusible compound may also be obtained by this process if the residual silver and silver halide are removed by any conventional manner well known to those skilled in the photographic art, such as a bleach bath followed by a fix bath, a bleach-fix bath, etc. Such a retained dye image should normally be treated with metal ions to metallize the dyes to increase their light fastness and shift their spectral absorption to the intended region. If a negative-working silver halide emulsion is employed in certain preferred photosensitive elements, described above, then a positive color image, such as a reflection print, a color transparency or motion picture film, may be produced in this manner. If a direct-positive silver halide emulsion is employed in such photosensitive elements, then a negative color image may be produced.

In the film unit, the dye or dye forming material released forms a coordination complex with the metal ions and the polymeric mordant. The formation of the coordination complex may shift the absorption of the dye to the desired hue, usually to longer wavelengths, which have a different absorption than that of the initial dye-releasing compound. If this shift is large enough, then the dye-releasing compound may be incorporated in a silver halide emulsion layer without adversely affecting its sensitivity. The dyes may also be shifted in a variety of ways well known in the art.

The dye image-receiving layer in the above-described film unit can be located on a separate support adapted to be superposed on the photographic element after exposure thereof. Such image-receiving elements are generally disclosed, for example, in U.S. Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film unit can also be located integral with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition between the photographic element and an opaque cover sheet as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention can be employed is disclosed in Belgian Pat. No. 757,959. In this embodiment, the support for the photographic element is transparent and is coated with the image-receiving layer, a substantially opaque, light-reflective layer and the photosensitive layer or layers described above. A rupturable container containing an alkaline processing composition and an opacifier is positioned adjacent the top layer and a transparent top sheet which has thereon a neutralizing layer and a timing layer. The film unit is placed in a camera, exposed through the transparent top sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images are formed as a result of development which diffuse to the image-receiving layer to provide a positive, right-reading image which is viewed through the transparent support on the opaque reflecting layer background. For further details concerning the format of this particular integral film unit, reference is made to the above-mentioned Belgian Patent 757,959.

Still other useful integral formats in which this invention can be employed are described in U.S. Pat. Nos. 3,415,644; 3,415,645; 3,415,646; 3,647,437; and 3,635,707. In most of these formats, a photosensitive silver halide emulsion is coated on an opaque support and a dye image-receiving layer is located on a separate transparent support superposed over the layer outermost from the opaque support. In addition, this transparent support also preferably contains a neutralizing layer and a timing layer underneath the dye image-receiving layer.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

The film unit or assembly used in the present invention may be used to produce positive images in single- or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive (initially or after forming the coordination complex), i.e., the blue-sensitive silver halide emulsion layer will have a yellow or yellow-forming dye-releaser associated therewith, the green-sensitive silver halide emulsion layer will have a magenta or magenta-forming dye-releaser associated therewith, and the red-sensitive silver halide emulsion layer will have a cyan or cyan-forming dye-releaser associated therewith, at least one of the dye-releasers being a compound in accordance with the present invention. The dye-release associated with each silver halide emulsion layer may be contained either in the silver halide emulsion layer itself, or in a layer contiguous to the silver halide emulsion layer.

The concentration of dye-releasing compounds that can be employed in the present invention may be varied over a wide range, depending upon the particular compound employed and the results which are desired. For example, dye-releasers may be coated in layers by using coating solutions containing between about 0.5 and about 8 percent by weight of the dye-releaser distributed in a hydrophilic film-forming natural material or synthetic polymer, such as gelatin, polyvinyl alcohol, etc, which is adapted to be permeated by aqueous alkaline processing composition.

Depending upon which CAR is used in the dye-releasing compound, a variety of silver halide developing agents can be employed. In certain embodiments of the invention, any silver halide developing agent can be employed, as long as it cross-oxidizes with the dye-releasers described herein. The developer may be employed in the photosensitive element to be activated by the alkaline processing composition. Specific examples of developers which can be employed in this embodiment include:

N-methylaminophenol
Phenidone (1-phenyl-3-pyrazolidone)
Dimezone (1-phenyl-4,4-dimethyl-3-pyrazolidone)
aminophenols
1-phenyl-4-methyl-4-hydroxymethyl-3-pyrazolidone
N,N-diethyl-p-phenylenediamine
N,N,N',N'-tetramethyl-p-phenylenediamine
3-methyl-N,N-diethyl-p-phenylenediamine
3-methoxy-N-ethyl-N-ethoxy-p-phenylenediamine, etc.

The non-chromogenic developers in this list are preferred, however, since they avoid any propensity of staining the dye image-receiving layer.

In one of the preferred embodiments of the invention, the silver halide developer employed in the process becomes oxidized upon development and reduces silver halide to silver metal. The oxidized developer then cross-oxidizes the dye-releasing compound. The product of cross-oxidation then undergoes alkaline hydrolysis, thus releasing an imagewise distribution of diffusible azo dye which then diffuses to the receiving layer to provide the dye image. The diffusible moiety is transferrable in alkaline processing composition either by virtue of its self-diffusivity or by having attached to it one or more solubilizing groups, for example, a carboxy, sulpho, sulphonamido, hydroxy or morpholino group.

In using dye-releasing compounds which produce diffusible dye images as a function of development, either conventional negative-working or direct-positive silver halide emulsions may be employed. If the silver halide emulsion employed is a direct-positive silver halide emulsion, such as an internal-image emulsion designed for use in the internal image reversal process or a fogged, direct-positive emulsion such as a solarizing emulsion, which is developable in unexposed areas, a positive image can be obtained in certain embodiments on the dye image-receiving layer. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a pH-lowering layer in the film unit or image-receiving unit lowers the pH of the film unit or image receiver to stabilize the image.

Internal-image silver halide emulsions useful in this invention are described more fully in the November 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized siler halide emulsion layers can be disposed in a different order, e.g., the blue-sensitive layer first with respect to the exposure side, followed by the red-sensitive and green-sensitive layers.

The rupturable container employed in certain embodiments of this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinal upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye-releasers are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Use of a pH-lowering material in the film units employed in this invention will usually increase the stability of the transferred image. Generally, the pH-lowering material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure* and pages 35 through 37 of July 1975 edition of *Research Disclosure,* the disclosures of which are hereby incorporated by reference.

A timing or inert spacer layer can be employed in the practice of this invention over the pH-lowering layer which "times" or controls the pH reduction as a function of the rate at which alkali diffuses throuh the inert spacer layer. Examples of such timing layers and their functioning are disclosed in the *Research Disclosure* articles mentioned in the paragraph above concerning pH-lowering layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably processing as a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

While the alkaline processing composition used in this invention can be employed in a rupturable container, as described previously, to conveniently facilitate the introduction of processing composition into the film unit, other methods of inserting processing composition into the film unit could also be employed, e.g., interjecting processing solution with communicating members similar to hypodermic syringes which are attached either to a camera or camera cartridge. The processing composition may also be applied by means of a swab or by dipping in a bath, if so desired.

The alkaline solution-permeable, substantially opaque, light-reflective layer employed in certain embodiments of photographic film units used in this invention are described more fully in the November 1976 edition of *Research Disclosure,* page 82, the disclosure of which is hereby incorporated by reference.

The supports for the photographic elements used in this invention can be any material as long as it does not deleteriously affect the photographic properties of the film unit and is dimensionally stable. Typical flexible sheet materials are described on page 85 of the November 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan colorproviding substances. After development, the transferred dyes would tend to fuse together into a continuous tone.

The silver halide emulsions useful in this invention, both negative-working and direct-positive ones, are well known to those skilled in the art and are described in *Product Licensing Index,* Volume 92, December 1971, publication 9232, page 107, paragraph I, "Emulsion types"; they may be chemically and spectrally sensitized as described on page 107, paragraph III, "Chemical sensitization," and pages 108 and 109, paragraph XV, "Spectral sensitization," of the above article; they can be protected against the production of fog and can be stabilized against loss of sensitivity during keeping by employing the materials described on page 107, paragraph V, "Antifoggants and stabilizers," of the above article; they can contain development modifiers, hardeners, and coating aids as described on pages 107 and 108, paragraph IV, "Development modifiers"; paragraph VII, "Hardeners"; and paragraph XII, "Coating aids," of the above article; they and other layers in the photographic elements used in this invention can contain plasticizers, vehicles and filter dyes described on page 108, paragraph XI, "Plasticizers and lubricants," and paragraph VIII, "Vehicles," and page 109, paragraph XVI, "Absorbing and filter dyes," of the above article; they and other layers in the photographic elements used in this invention may contain addenda which are incorporated by using the procedures described on page 109, paragraph XVII, "Methods of addition," of the above article; and they can be coated by using the various techniques described on page 109, paragraph XVIII, "Coating procedures," of the above article; the disclosures of which are hereby incorporated by reference.

The term "nondiffusing" used herein has the meaning commonly applied to the term in photography and denotes materials that for all practical purposes do not migrate nor wander through organic colloid layers, such as gelatin, in an alkaline medium, in the photographic elements of the invention and preferably when processed in a medium having a pH of 11 or greater. The same meaning is to be attached to the term "immobile." The term "diffucible" as applied to the materials of this invention has the converse meaning and denotes materials having the property of diffusing effectively through the colloid layers of the photographic elements in an alkaline medium in the presence of "non-diffusing" materials. "Mobile" has the same meaning.

In the preferred embodiment, the film unit is an integral film unit wherein the receiver, dye forming layer and cover sheet are permanently attached to one another before, during and after processing.

The term "associated therewith" as used herein means that the dye ligand or dye ligand forming material is located in either the same layer as the silver halide emulsion or in an adjacent layer, so that when the silver halide development takes place the dye or dye forming material will be released from the dye releasing material and allowed to diffuse to the image-receiving layer in an imagewise fashion.

The drawing illustrates the product of the process of the invention, which product comprises producing a photographic transfer image in a photograhic element comprising a support having thereon at least one photosensitive silver halide emulsion layer having associated therewith a dye ligand or dye ligand former and an image-receiving composite containing a dye image-receiving layer comprising:

(a) exposing and treating said element with an alkaline processing composition in the presence of a silver halide developing agent to effect development of each of said exposed silver halide emulsion layers;

(1) an imagewise distribution of dye ligand or dye ligand former being formed as a function of development; and (2) at least a portion of said imagewise distribution of dye ligand or dye ligand former diffusing to said dye image-receiving layer;

wherein said dye image-receiving composite comprises a first layer comprising a course of metal transition ions and a binder therefor, and a second layer located between said first layer and said photosensitive silver halide emulsion layers, and comprising a polymer containing a heterocyclic tertiary amine group. Thus, the film unit 1 can comprise the support layer 2 coated with the metal ion source to form layer 3. Layer 4 represents the mordant layer. Layer 5 represents the optional reflecting layer which is generally $TiO_2$ in gelatin, and layer 6 represents the optical opaque layer which is generally carbon in gelatin. The image-forming layers containing the silver halide emulsions and dye or dye forming materials are represented by layer 7. The processing composition and means for releasing same 8 are introduced preferably between the image-forming layers and the cover sheet which comprises timing layer 9, acid layer 10 and support layer 11. The following examples are presented for a further understanding of the invention.

EXAMPLE 1

Preparation of Receiving Layers

A. Mordant Composition

Solutions A and B were prepared as follows:

| Solution A | | Solution B | |
|---|---|---|---|
| Poly(4-vinyl pyridine) | 220 g | Pigskin gelatin | 69 g |
| Distilled water | 2015 ml | Distilled water | 1500 ml |
| Lactic acid | 65 g | pH | 5.0 |

Solution A (732 g) was added to Solution B, combined with Surfactant 10 G (10 percent by weight, 21 ml) and the mixture was diluted to a total volume of 2.55 liters (pH 4.1).

B. Nickel Salt Composition

The following solutions were prepared at 40° C.

| Solution C | | Solution D | |
|---|---|---|---|
| Pigskin gelatin | 48 g | $NiSO_4 \cdot 6H_2O$ | 12.9 g |
| Distilled water | 1200 ml | Surfactant 10G (10% by weight) | 14.0 ml |

Solutions C and D were combined and diluted to 1500 g (pH 4.4).

C. Preparation of the Coating

The nickel salt composition was coated on a polyester film support at 2.15 g of gelatin/$m^2$ and 0.58 g of $NiSO_4.6H_2O/m^2$. This dried layer was overcoated with the mordant composition at 2.15 g/$m^2$ of gelatin and poly(4-vinylpyridine).

The following layers were coated over the mordant layer of Example 1. All coverages (in parentheses) are in g/$m^2$, unless otherwise specified.

(1) A reflecting layer containing a commercial silica and alumina treated grade of titanium dioxide (16.1) and gelatin (2.6).

(2) An opaque layer containing carbon black (1.87) and gelatin (2.58).

(3) A layer of a magenta dye-releasing compound A* (1.08) dispersed with di-n-butyl phthalate (1.08) in gelatin (2.43).

(4) A green-sensitive internal image emulsion (2.69 Ag, 2.69 gelatin), such as described in Evans, U.S. Pat. 3,761,276, with fogging agents NA-16 and H-25 of Leone et al, U.S. Pat. 4,030,925, issued June 21, 1977, and 5-octadecylhydroquinone-2-sulfonic acid (16 g/mole Ag).

(5) A scavenger layer of gelatin (1.61) and dodecylhydroquinone (1.29).

(6) A gelatin overcoat layer.

*Compound A

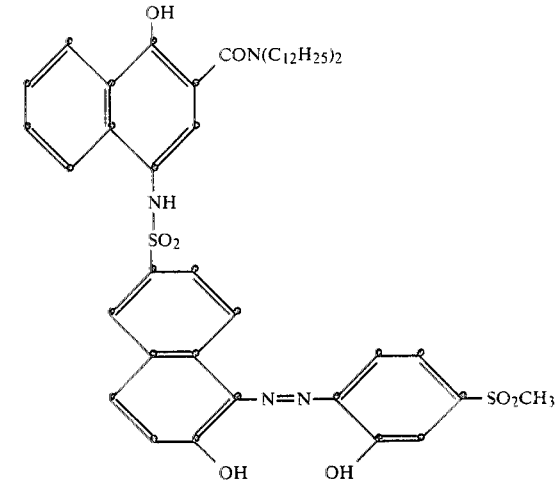

EXAMPLE 2

This is a comparative example. A receiving element comprising gelatin (2.28 g/$m^2$), $NiSO_4.6H_2O$ (0.58 g/$m^2$) and a latex, poly(styrene-co-N-benzyl-N,N-dimethyl-N-vinylbenzyl-ammonium sulfate-co-divinylbenzene) (2.28 g/$m^2$) was coated on a polyester support.

Example 2 is like Example 1, except that layers 1 through 6 were coated upon the receiving element of Example 2.

Both integral image receiving elements (Examples 1 and 2) were analyzed for metallic nickel using atomic absorption spectra in order to demonstrate the immobilization of the nickel ions. The coatings were (1) examined intact, (2) with layers 2 through 6 removed, and (3) with layers 3 through 6 removed. Table I lists the analytical results.

TABLE I

| | (Ni g/$m^2$)* Layers Removed | | |
|---|---|---|---|
| | None | 2-6 | 3-6 |
| Example 1 | 0.15 | 0.15 | 0.16 |
| Example 2 | 0.12 | 0.06 | 0.05 |

*Theoretical amount 0.13 g/$m^2$

Note the total immobilization of $Ni^{+2}$ by the receiving element of Example 1, whereas $Ni^{+2}$ diffused through the mordant layer of Example 2 into layers 2 through 6.

EXAMPLE 3

Example 3 is like Example 1, except that the $NiSO_4.6H_2O$/gelatin layer was NOT present in the image-receiving element.

Examples 1 and 3 were exposed to a multicolor test object, then processed by spreading a viscous processing composition between it and a processing cover sheet at 22° C., as described in Hannie et al, U.S. Pat. No. 4,061,496, issued Dec. 6, 1977, and passing the transfer "sandwich" between a pair of juxtaposed rollers so that the liquid layer was about 75 μm. The Examples were subjected to 16 weeks of a simulated average northern skylight (SANS, 500 footcandles) fading test. The green density loss (ΔD) was determined from spectrophotometric curves at 1.0 density.

TABLE II

| Example | $Ni^{+2}$ | 16-week SANS ΔD |
|---|---|---|
| 1 | Yes | −0.01 |
| 3 | No | −0.25 |

The above data demonstrate the excellent light stability of the dye metallized on an image-receiving element comprising poly(4-vinylpyridine)/$Ni^{+2}$ mordant combination compared to an image-receiving element containing no $Ni^{+2}$ ions.

Receiving elements were also prepared using poly(-vinylimidazole) in place of poly(vinylpyridine). Similar results were obtained.

The invention has been described in detail with particular reference to preferred embodiments thereof, but it will be understood that variations and modifications can be effected within the spirit and scope of the invention.

What is claimed is:

1. An image receiving element comprising a support having thereon in order:

(1) a layer comprising a source of metal ions; and (2) a dye-image receiving layer wherein the dye-image receiving layer comprises a homopolymer of vinylimidazole.

2. The element of claim 1 wherein the metal ions are selected from the group consisting of $Ni^{+2}$, $Cu^{+2}$, $Co^{+2}$ and $Zn^{+2}$.

3. The element of claim 1 wherein the layer comprising said source of metal ions contains a binder.

4. The element of claim 3 wherein the binder is gelatin.

5. An image transfer film unit comprising a support having thereon in order:

(1) a layer comprising a source of metal ions;

(2) a dye-image receiving layer; and (3) at least one layer containing a photosensitive silver halide emulsion having associated therewith a dye ligand or dye ligand former;

said film unit containing an alkaline processing composition and means for discharging same within said film unit in contact with said photosensitive silver halide emulsion, and a silver halide developing agent; and said dye-image receiving layer comprising a homopolymer of vinylimidazole.

6. The image transfer film unit of claim 5 wherein the metal ions are selected from the group consisting of $Ni^{+2}$, $Cu^{+2}$, $Co^{+2}$ and $Zn^{+2}$.

7. The image transfer film unit of claim 5 wherein the layer containing said source of metal ions contains a binder.

8. The image transfer film unit of claim 7 wherein the binder is gelatin.

9. The image transfer film unit of claim 5 wherein the dye-image receiving layer is contiguous to the layer comprising the source of metal ions.

10. An image transfer film unit comprising a support having thereon:

(1) a layer comprising a source of metal ions;

(2) a dye-image receiving layer; and (3) at least one layer containing a photosensitive silver halide emulsion having associated therewith a dye ligand or dye ligand former;

said layer comprising metal ions being located on the side of the dye-image receiving layer furthest from the photosensitive silver halide emulsion, said film unit containing an alkaline processing composition and means for discharging said within said film unit in contact with said photosensitive silver halide emulsion; and a silver halide developing agent; and said dye-image receiving layer comprising a homopolymer of vinylimidazole.

11. In an integral photographic assemblage comprising:

(1) a photosensitive element comprising a transparent support having thereon the following layers in sequence: a dye-image receiving combination, an alkaline solution-permeable, light-reflective layer, an alkaline solution-permeable, opaque layer, a red-sensitive silver halide emeulsion layer having a ballasted cyan dye ligand or ligand former releaser associated therewith, a green-sensitive silver halide emulsion layer having a ballasted magenta dye ligand or ligand former releaser associated therewith, and a blue-sensitive silver halide emulsion layer having a ballasted yellow dye ligand or ligand former releaser associated therewith;

(2) a transparent sheet superposed over said blue-sensitive silver halide emulsion layer and comprising a transparent support having thereon, in sequence, a neutralizing layer and a timing layer; and (3) a rupturable container containing an alkaline processing composition and an opacifying agent which is so positioned during processing of said assemblage that a compressive force applied to said container will effect a discharge of the container's contents between said transparent sheet and said blue-sensitive silver halide emulsion layer, said assemblage containing a silver halide developing agent;

the improvement wherein the dye-image receiving combination comprises a layer comprising a source of metal ions and a dye-image receiving layer comprising a homopolymer of vinylimidazole wherein the layer comprising the source of metal ions is located on the side of the dye-image receiving layer furthest from the nearest photosensitive silver halide emulsion layer.

12. The image transfer film unit of claim 11 wherein the metal ions are selected from the group consisting of $Ni^{+2}$, $Cu^{+2}$, $Co^{+2}$ and $Zn^{+2}$.

13. The image transfer film unit of claim 11 wherein the layer comprising said source of metal ions contains a binder.

14. The image transfer film unit of claim 13 wherein the binder is gelatin.

15. The image transfer film unit of claim 11 wherein said dyes are released as an inverse function of said development of said silver halide emulsion layers under alkaline conditions.

16. An image transfer film unit comprising a support having thereon in order:

(1) a layer comprising a source of metal ions;
(2) a dye-image receiving layer;
(3) at least one layer containing a photosensitive silver halide emulsion layer having associated therewith a dye ligand or dye ligand former;
(4) an alkaline processing composition and means for discharging same with said film unit in contact with said photosensitive silver halide emulsion layers;
(5) a neutralizing layer for neutralizing said alkaline processing composition; and
(6) a barrier which is permeable by said alkaline processing composition after a predetermined time located between said neutralizing layer and said photosensitive silver halide emulsion layer;

said film unit containing a silver halide developing agent and wherein said layer contains metal ions being located on the side of the dye image-receiving layer furthest from the photosensitive silver halide emulsion layers and the dye image-receiving layer comprises a homopolymer of vinylimidazole.

17. The image transfer film unit of claim 16 wherein the metal ions are selected from the group consisting of $Ni^{+2}$, $Cu^{+2}$, $Co^{+2}$ and $Zn^{+2}$.

18. The image transfer film unit of claim 16 wherein the layer comprising said source of metal ions contains a binder.

19. The image transfer film unit of claim 18 wherein the binder is gelatin.

20. The image transfer film unit of claim 16 wherein the dye-image receiving layer is contiguous to the layer comprising the source of metal ions.

21. In a process of producing a photographic transfer image in an imagewise exposed photographic element comprising a support having thereon at least one photosensitive silver halide emulsion layer having associated therewith a dye ligand or dye ligand former, and an image-receiving composite containing a dye-image receiving layer comprising treating said element with an alkaline processing composition in the presence of a silver halide developing agent to effect development of each of said exposed silver halide emulsion layers:

(1) an imagewise distribution of dye ligand or dye ligand former being formed as a function of development; and
(2) at least a portion of said imagewise distribution of dye ligand or dye ligand former diffusing to said dye-image receiving layer;

the improvement wherein said dye-image receiving composite comprises a first layer comprising a source of metal ions and a binder therefor, and a second layer located between said first layer and said photosensitive silver halide emulsion layers and comprising a homopolymer of vinylimidazole.

22. The process of claim 21 wherein the metal ions are selected from the group consisting of $Ni^{+2}$, $Cu^{+2}$, $Co^{+2}$ and $Zn^{+2}$.

23. The process of claim 21 wherein the binder is gelatin.

24. The process of claim 21 wherein the dye-receiving layer is directly over the layer comprising the source of metal ions.

25. A process of combining, from opposite sides of a mordant layer, said mordant layer comprising a homopolymer of vinylimidazole; a dye ligand or dye ligand former and a source of metal ions, said process comprising:

(1) imagewise-exposing a photographic element comprising a support having thereon at least one photosensitive silver halide emulsion layer having associated therewith a dye ligand or dye ligand former and an image-receiving composite containing a dye image-receiving layer; and
(2) treating said element with an alkaline processing composition in the presence of a silver halide developing agent to effect development of each of said exposed silver halide emulsion layers:
   (a) an imagewise distribution of dye ligand or dye ligand former being formed as a function of development; and
   (b) at least a portion of said imagewise distribution of dye ligand or dye ligand former diffusing to said dye-image receiving layer and combining with said metal ions.

* * * * *